United States Patent [19]

DiVito et al.

[11] Patent Number: 4,583,080

[45] Date of Patent: Apr. 15, 1986

[54] AUDIBLE ALARM AND PROJECTION LAMP ATTACHMENT FOR A WALKING CANE

[75] Inventors: Fred DiVito, North Port; Michael R. Shields, Nesconset, both of N.Y.

[73] Assignee: Lumex, Inc., Bay Shore, N.Y.

[21] Appl. No.: 687,037

[22] Filed: Dec. 28, 1984

[51] Int. Cl.[4] ..... G08B 23/00; A45B 3/02; A63B 15/02

[52] U.S. Cl. ..... 340/407; 340/321; 362/102

[58] Field of Search ..... 340/321, 333, 327, 326, 340/407; 362/102, 196; 455/349, 351, 95, 89

[56] References Cited

U.S. PATENT DOCUMENTS

| | | | |
|---|---|---|---|
| 2,893,344 | 7/1959 | Meyers | 340/321 |
| 3,533,094 | 10/1970 | Brelje | 340/327 |
| 3,622,979 | 11/1971 | Dickerson | 340/333 |
| 3,701,016 | 10/1972 | Bennett et al. | 455/89 |
| 4,048,746 | 9/1977 | Dye | 43/98 |
| 4,280,204 | 7/1981 | Elchinger | 343/5 BL |

*Primary Examiner*—Ulysses Weldon
*Assistant Examiner*—Ralph E. Smith
*Attorney, Agent, or Firm*—Edward H. Loveman

[57] ABSTRACT

An attachment for a walking cane to serve as audible alarm producing means and as a light projection lamp. The attachment has a hollow casing for mounting onto a cane so that a vertical portion of the cane protrudes from the front section of the casing and the horizontal portion of the cane protrudes from the rear section of the casing. Inside the casing, is a switch connected in circuit with an audible alarm producing device, a lamp and batteries. The switch is operable externally of the casing for selectively sounding the alarm or lighting the lamp. The casing has quickly separable and reengageable sections providing access to the interior or the casing for servicing the batteries. The sound actuating circuit may be arranged to modify the sound produced by the alarm device to increase its attention getting effect.

4 Claims, 8 Drawing Figures

AUDIBLE ALARM AND PROJECTION LAMP ATTACHMENT FOR A WALKING CANE

BACKGROUND OF THE INVENTION

1. Field of the Invention

This invention relates to the art of walking canes used by ambulatory, infirm, or disabled persons who employ a cane to assist them in walking, and more particularly concerns an attachment which may be mounted on the handle of a conventional walking cane, to provide the user with an audible alarm and lamp, conveniently available when needed.

2. State of the Art

According to the invention there is provided an elongated housing or casing having an opening in each end so that the housing maybe mounted on the walking cane. When mounted, the vertical portion of the cane protrudes from the front section of the housing, and the horizontal portion of the cane protrudes from the other end of the housing. At the other end of the housing or casing, is a manually operable switch which may be thrown to selectively operate a battery powered audible alarm device, or a battery powered lamp. The lamp projects a light through an opening in one side of the casing to illuminate a walking surface immediately in front of the user of the assembly.

BRIEF SUMMARY OF THE INVENTION

The alarm device is intended for use in an emergency. It can be provided with circuit to cause the audible signal emitted by the alarm device to fluctuate in amplitude, to increase the attention getting effect of the alarm. The alarm device may be a bell, buzzer, siren, or the like.

OBJECTS OF THE INVENTION

It is therefore a principal object of the present invention to provide an attachment or adapter for a walking cane, arranged to serve as a handle for the cane, and include a selectively operable audible alarm device and light emitting lamp.

A further object of the present invention is to provide an attachment as described, provided with battery powered circuitry selectively actuatable by a manually operable switch on the attachment.

Another object of the present invention is to provide an attachment as described wherein the circuit for operating the audible alarm device has means for varying the amplitude of the audible alarm.

Still another object of the present invention is to provide an attachment as described, wherein the attachment includes a casing enclosing the alarm device and lamp, which casing is quickly mountable on and detachable from the handle of a walking cane.

A further object of the present invention is to provide an attachment as described, which is light in weight, relatively inexpensive to manufacture, and simple in construction, but which is nevertheless durable, strong, and reliable to perform its intended functions.

These and other objects and many of the attendant advantages of this invention will be readily appreciated as the same becomes better understood by reference to the following detailed description when considered in connection with the accompanying drawings in which:

DETAILED DESCRIPTION OF THE INVENTION

Figure 1:
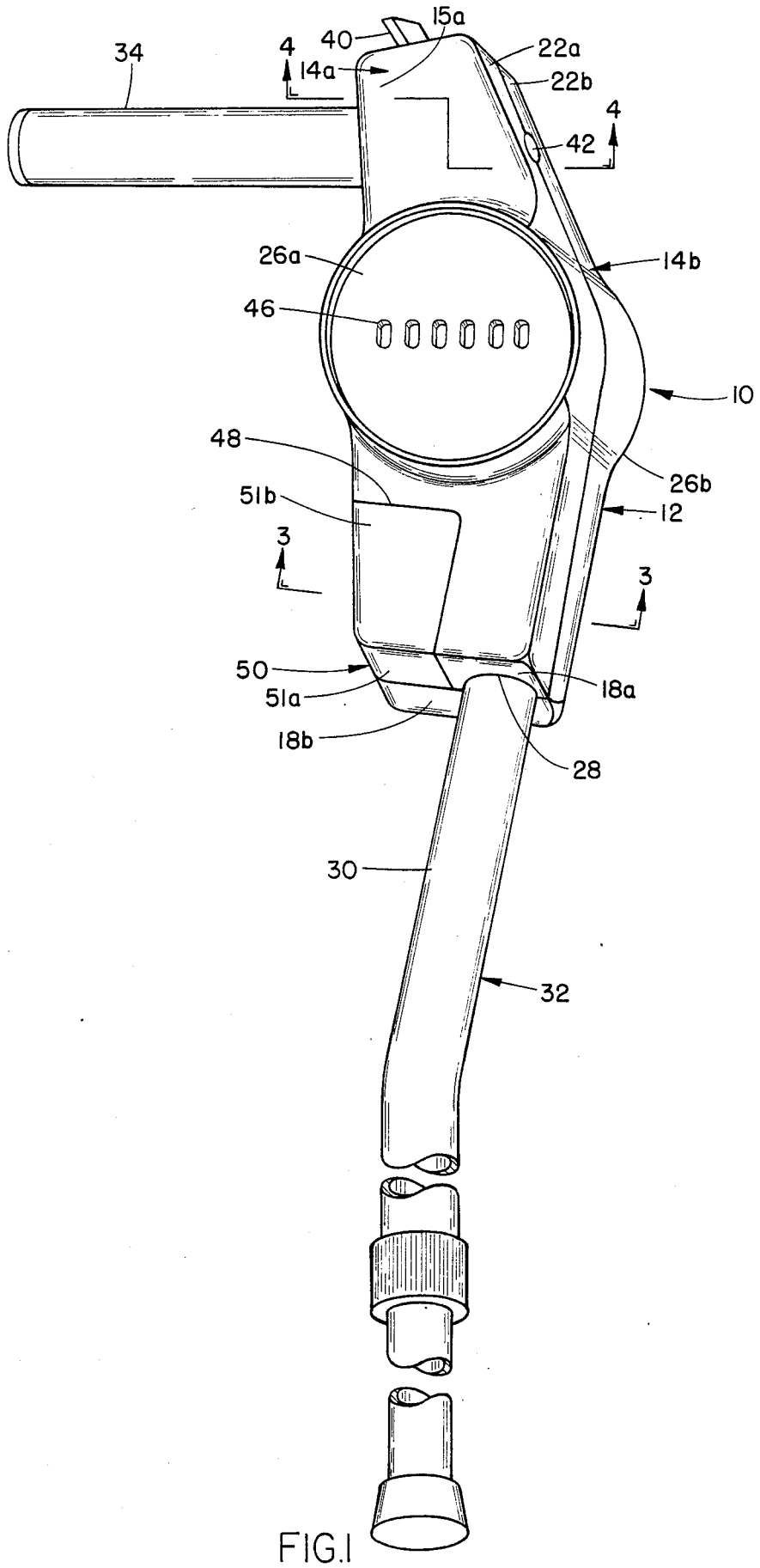
FIG. 1 is a perspective view of a cane attachment embodying the invention shown mounted a walking cane.
Figure 2:
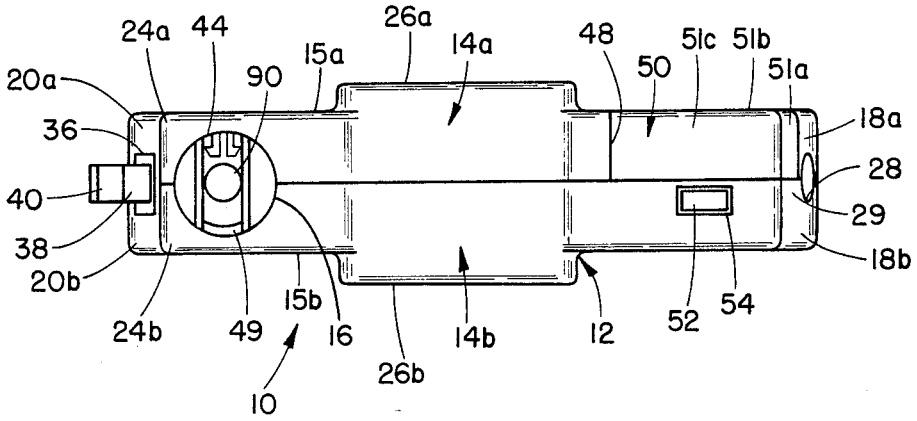
FIG. 2 is a bottom plan view of the cane attachment itself.

Referring now to the drawings wherein like reference characters designate like or corresponding parts throughout, there is illustrated in FIGS. 1 and 2 a cane attachment, device, or adapter generally designated as reference numeral 10 embodying the invention. The cane attachment 10 has an elongated casing 12 made in two mating parts or shell-like sections 14*a*, 14*b* which have rather flat opposite sides 15*a*, 15*b*; front end walls 18*a*, 18*b*; rear end walls 20*a*, 20*b*; top walls 22*a*, 22*b*; and bottom walls 24*a*, 24*b*; round, enlarged central portions 26*a*, 26*b* of the two sections 14*a*, 14*b*, are extended laterally, upwardly and downwardly for purposes described below.

The front end walls 18*a*, 18*b* are formed with mating semicircular cutouts 28 defining a round hole 29 through which a vertical straight portion 30 of a walking cane 32 may be inserted. Similarly, the bottom end walls 24*a*, 24*b* are formed with semicircular cutouts 16 defining a round hole 44 through which a horizontal straight portion 34 of the walking cane 32 protrudes. At the rear end walls 20*a*, 20*b* is an opening 36 in which is a switch 38 having a manually operable handle 40 extending rearwardly from the casing 12. A small opening 42 is formed in the top walls 22*a*, 22*b*, and a larger opening 44 is formed in the bottom walls 24*a*, 24*b*. Openings 42 and 44 are disposed near the rear end of the casing 12.

A plurality of lateral openings 46 are formed in the side wall 15*a* at central portion 26*a* to permit audible alarm signals to pass freely out of the casing 12. A cutout 48 is formed at the front end of section 14*a*. A casing section 50 has three small walls 51*a*,51*b*,51*c*, removably fitted in the cutout 48. Referring now to FIGS. 3, 4, 5, and 6, there is best shown the internal construction of the attachment or device 10 embodying the invention.

Figure 3:
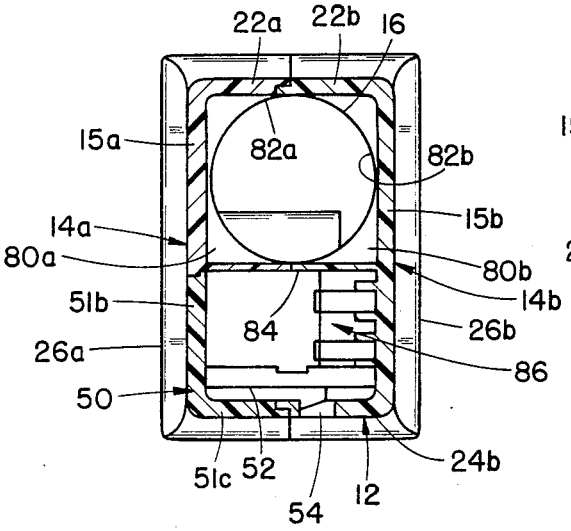
FIG. 3 and FIG. 4 are enlarged cross sectional views taken along lines 3—3 and 4—4 respectively of FIG. 1, with the cane removed.
Figure 4:
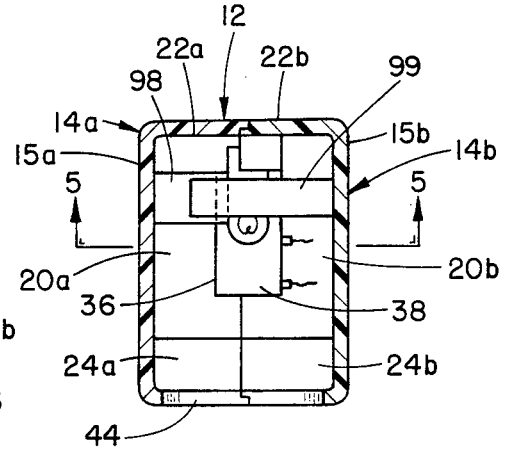
Figure 5:
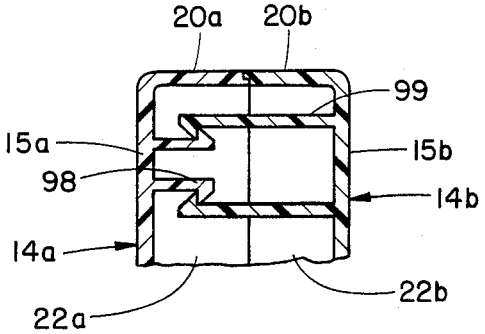
FIG. 5 is a fragmentary cross-sectional view taken along line 5—5 of FIG. 4.
Figure 6:
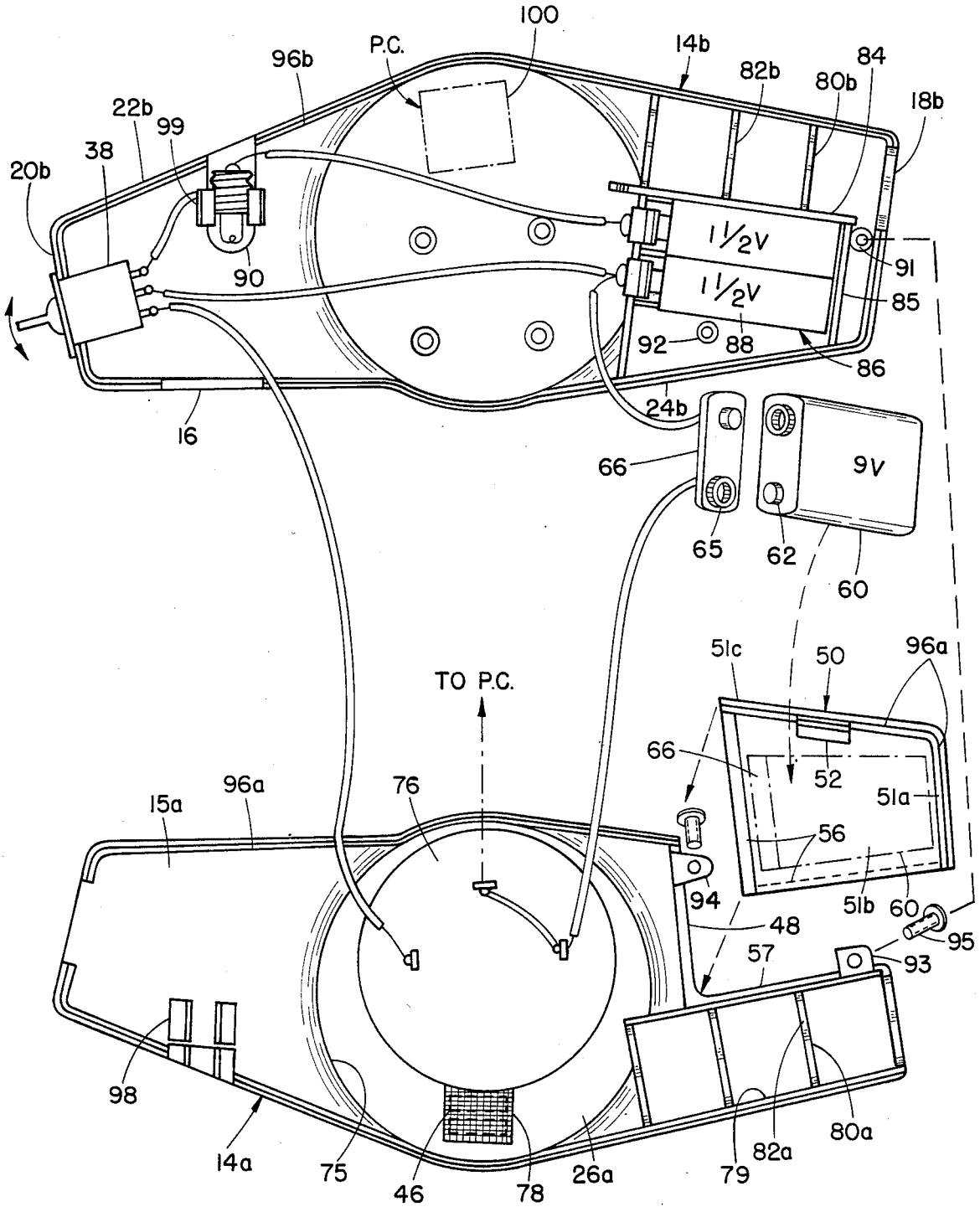
FIG. 6 is a plan view of two parts of the casing of the attachment laid out in open position to show internal construction, with some members being shown in exploded position.

The casing insert 50 is provided with a flexible hook 52 which extends from the wall 51*b* across to the wall 51*c* and snaps into engagement with the rim of a rectangular hole 54 in the bottom wall 24*b* of the casing section 14*b* near its front end; see FIGS. 2, 3, and 6. The free edges of the insert walls 51*b* are provided with rabbets 56 which interfit with corresponding rabbets 57 at mating edges of the cutout 48 in section 14*a* while a hook 52 engages in a hole 54 in the wall 24*b*. This arrangement holds the insert 50 securely but removable in place. A flat 9 volt battery 60 is insertable inside the insert 50 as shown in solid and dotted lines in FIG. 6.

Terminals 62 of the battery 60 may be connected to terminals 65 of a connector clip 66 which also fits into the insert 50. The clip terminals 65 are connected by wires in a circuit 100 shown in detail in FIG. 7, and discussed below.

Mounted in a well 75 at the inner side of the casing extension 26*a* is an audible alarm device 76; see FIG. 6. The holes 46 in the casing extension 26*a* may be covered by a strip of grill cloth 78. Inside the forward end of the casing section 14*a* is elongated cavity 79 formed with spaced ribs 80*a* having semicircular concave edges 82*a*. The ribs 80*a* engage one side of the cane portion 30 when it is inserted in casing 12. A mating set of spaced ribs 80*b* is formed at the forward end of casing section 14*b*. Ribs 80*b* have concave edges 82*b* to engage the other side of the cane portion 30. The ribs 80*b* are integral with partitions 84, 85 in the forward part of casing section 14*b* to define a cavity 86 which receives a pair of size AA batteries 88.

Batteries 88 are connected by wires in circuit with the switch 38 located at the rear end of the casing section 14*a*, and with a lamp bulb 90 mounted in casing section 14*a* in alignment with the upper hole 42; see FIG. 2. The switch 38 is a single pole, double throw switch. The light from the lamp 90 is projected through the hole 42 to illuminate a ground or floor area under the device 10. When the switch handle 40 is moved down, it closes the circuit connecting the alarm device 76 and the battery 60 so that the alarm sounds. The alarm will sound continuously until the switch handle 40 is restored to the center, or off position.

In order to secure the casing sections 14*a* and 14*b* together, there is provided a pair of threaded bosses 91 and 92 adjacent front wall 18*b* and bottom wall 24*b* of section 14*b*. A pair or ears or apertured tabs 93, 94 extend from edges of cutout 48 in section 14*a* to register with bosses 91, 92 and to receive screws 95 which secure the casing sections 14*a*, 14*b* together. The casing sections 14 are further provided with rabbets 96*b* on free edges of casing walls 18*b*, 20*b*, 22*b* and 24*b*. The rabbets 96*b* interfit with mating rabbets 96*a*, 96*a'* on free edges of the walls 20*a*, 22*a*, 24*a*, of the casing section 14*a* and on free edges of insert walls 51*a*, 51*c*. Furthermore there is provided a pair of spaced hooks 98 integral with and extending inwardly from the side wall 15*a*. The hooks 98 snap into engagement with more widely spaced hooks 99 extending inwardly from the casing side wall 15*b*; see FIGS. 4, 5, and 6. The two casing sections 15*a*, 15*b* are thus held together by the screws 95, hooks 98, 99 and interfitting rabbets 96*a*, 96*a'*, 96*b*.

Figure 7:
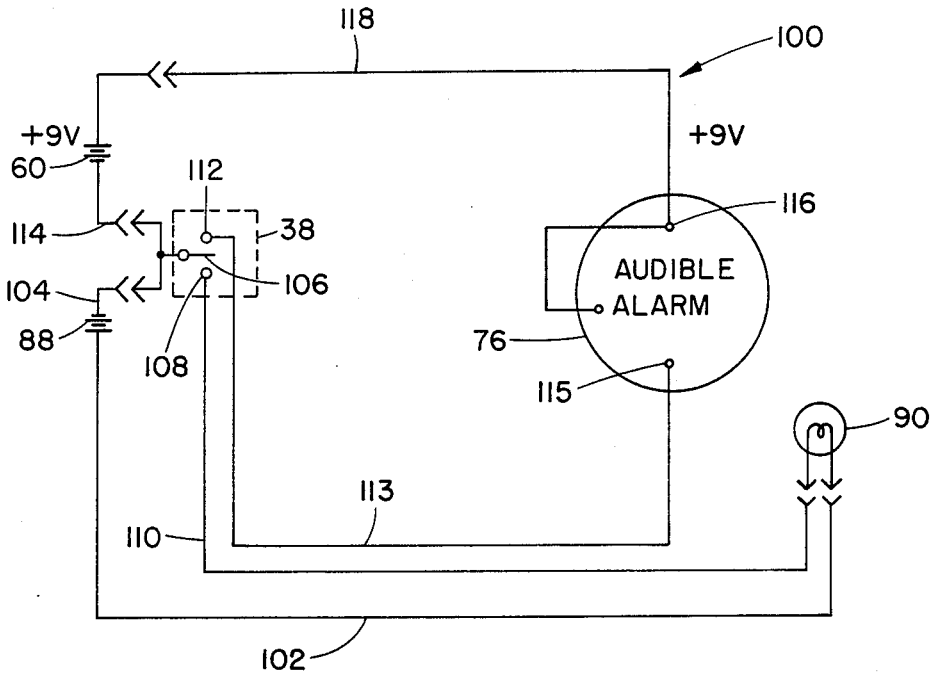
FIG. 7 is schematic diagram of the battery powered circuitry of the cane attachment.

Circuit 100 shown in FIG. 7, includes batteries 88 which are connected via a wire 102 to lamp bulb 90 and via a wire 104 to a movable pole 106 of the switch 38. A fixed switch contact 108 is connected by a wire 110 to the lamp bulb 90. When the pole 106 is in one position it closes with switch contact 108 and the lamp 90 lights. The switch 38 has another fixed contact 112 connected by a wire 113 to a terminal 115 of alarm device 76. A contact 112 is closed with the pole 106 in another switch position.

The battery 60 is connected in circuit with the switch pole 106 via a wire 114. The battery 60 is also connected to a terminal 116 of the alarm device 76 via a wire 118. When pole 106 is closed with switch contact 112, the alarm device is energized across terminals 115, 116 and the alarm sounds continuously until switch handle 40 is moved to center or off position shown in FIGS. 1, 2, and 6.

Figure 8:
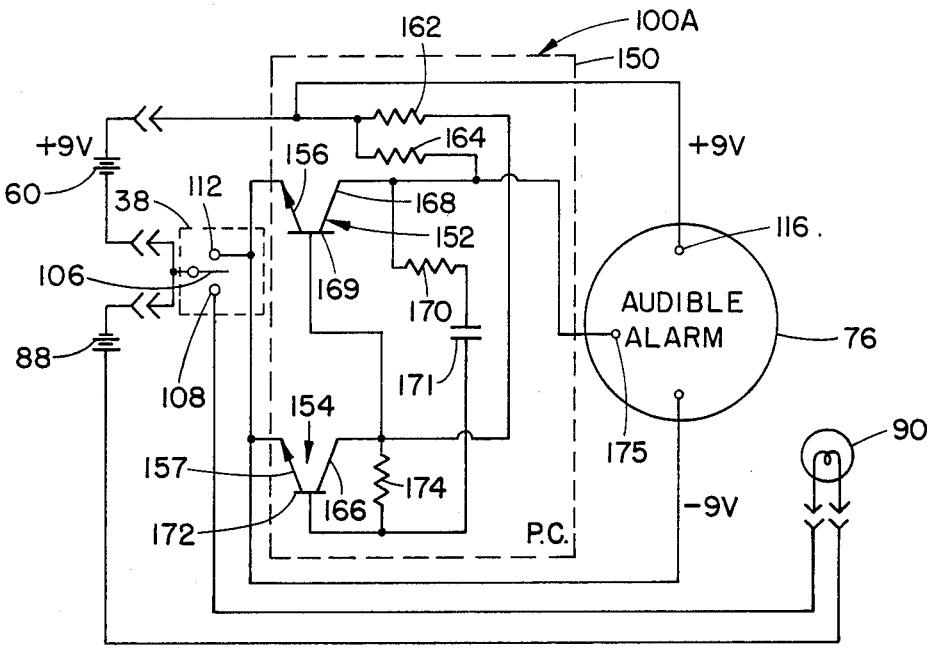
FIG. 8, is a schematic diagram of an alternate circuit which may be used in the cane attachment.

Circuit 100A shown in FIG. 8 can be used if a sound fluctuating in amplitude is desired to be emitted by the alarm device. Circuit 100A is identical to circuit 100 insofar as lamp 90, batteries 60, 88, pole 106, and contact 108 of switch 38 are concerned. A printed circuit (P.C.) board 150 is mounted inside the casing 12 as shown by dotted lines in FIG. 6. This circuit includes transistor amplifiers 152 and 154. The respective emitters thereof 156, 157, are connected to the fixed switch contact 112. The pole 106 is connected to one terminal of the battery 60. The other terminal of the battery 60 is connected to terminal 116 of the alarm device 76 and to resistors 162, 164 to collectors 168, 166 of respective transistors 152, 154 and base 169 of the transistor 152. An R-C circuit including a resistor 170 and a capacitor 171 is connected between the collector 168 of the transistor 154 and the base 172 of the transistor 154. A resistor 174 is connected between the collector 166 and the base 172 of the transistor 154. The collector 168 is connected to a common terminal 175 of alarm device 76.

When the pole 106 is closed with the switch contact 112 a variable resistance is in effect applied to the alarm device 76 by the circuit 150, which causes the audible alarm or signal emitted by the alarm device 76 to fluctuate in amplitude.

In use of either circuit 100 or 100A, the lamp 90 and the alarm device 71 are selectively operated manually at the option of the user. When the lamp is lit it will illuminate the floor or ground in the immediate vicinity of the cane 32. The lamp circuit can be actuated when the user is ascending or descending stairs to illuminate the stair area around the user. If the cane is lifted, the lamp can be used to illuminate a vertical wall or door area, keyhole, door handle, mail box, etc.

The alarm device 76 may be sounded in the event of an amergency. The alarm device 76 will sound continuously until it is turned off. If desired, the alarm device 76 can emit a fluctuating high pitched sound which will be immediately recognized as an emergency signal.

The attachment 10 can be readily interchanged with different canes and can be removed when desired. When removed, the attachment can serve as an independent flashlight, or 5 alternatively as an independent audible alarm producing device.

The casing is easily openable to insert and remove the lamp bulb, and/or batteries. The insert 50 can be removed to insert and replace batteries 88 without opening the case. The attachment is light in weight, relatively simple in construction, and inexpensive to manufacture. It will provide long, useful, reliable service.

It should be understood that the foregoing relates to only a limited number of preferred embodiments of the invention which have been by way of example only, and that it is intended to cover all changes and modifications of the example of the invention herein chosen for the purpose of the disclosure, which do not constitute departures from the spirit and scope of the invention:

What is claimed is:

1. An attachment for a walking cane, comprising:

an elongated hollow casing having opposed side walls, opposed front and rear end walls, and opposed top and bottom walls;

said front end wall having an opening to receive a vertical portion of said walking cane, and said rear wall having an opening for a horizontal portion of said cane to protrude therefrom, said casing having internal means for grasping said portion of said cane inserted through said casing;

an electrically operable sound emitting alarm device mounted in said casing between said side walls;

a lamp means in said casing, said casing having another opening in one of said walls for projecting light from said lamp means out of said casing;

manually operable switch means carried by said casing and disposed for manual operation externally of said casing; said switch means having a plurality of switch positions, respectively arranged so that said alarm device and said lamp means may be selectively operated, depending on the particular switch position manually selected for operation;

battery means in said casing;

circuit means electrically connecting said alarm device, and said lamp means to said battery means, via said switch means for energizing and actuating said alarm device or said lamp means by operation of said switch means; and variable resistance means in said casing connected in circuit with said battery means and said alarm device and arranged to fluctuate the sound emitted by said alarm device for increasing its attention-getting effect.

2. An attachment for a walking cane as defined in claim 1, wherein said side walls and said top and bottom walls are so shaped near said rear end wall as to serve as a handle for holding said casing, and whereby said attachment can serve as an independent sound producing and light emitting means when detached from said cane.

3. An attachment for a walking cane as defined in claim 1, wherein said casing is defined by two shell-like sections detachable secured together, and arranged to be quickly opened for placing and replacing said battery means in said casing.

4. An attachment for a walking cane as defined in claim 3, wherein said other opening is formed in said top wall of said casing, so that said light projected from said lamp illuminates an area beneath said casing when said casing is installed on said cane; and whereby said attachment can serve selectively as an audible alarm producing means and as a flashlight when detached from said cane.

* * * * *